US007273188B2

(12) United States Patent
Saha

(10) Patent No.: US 7,273,188 B2
(45) Date of Patent: Sep. 25, 2007

(54) INTERNAL SELF-ROTATING FLUID JETTING NOZZLE

(76) Inventor: Darrell R Saha, 14706 Park Almeda, Houston, TX (US) 77047

( * ) Notice: Subject to any disclaimer, the term of this patent is extended or adjusted under 35 U.S.C. 154(b) by 81 days.

(21) Appl. No.: 10/916,925

(22) Filed: Aug. 12, 2004

(65) Prior Publication Data

US 2005/0035214 A1 Feb. 17, 2005

Related U.S. Application Data

(60) Provisional application No. 60/495,593, filed on Aug. 15, 2003.

(51) Int. Cl.
*B05B 3/04* (2006.01)

(52) U.S. Cl. ..... 239/237; 239/380; 239/381; 239/240; 239/252; 239/264; 239/596

(58) Field of Classification Search ..... 239/225.1, 239/237, 240, 251, 252, 259, 261, 264, 589, 239/380–383, 596, 600
See application file for complete search history.

(56) References Cited

U.S. PATENT DOCUMENTS

| | | | | |
|---|---|---|---|---|
| 5,328,097 | A | 7/1994 | Wesch et al. | |
| 5,395,053 | A * | 3/1995 | Frech | 239/227 |
| 5,598,975 | A * | 2/1997 | Jager | 239/240 |
| 6,029,906 | A * | 2/2000 | Binder et al. | 239/381 |
| 6,250,566 | B1 * | 6/2001 | Jager | 239/237 |

* cited by examiner

*Primary Examiner*—Steven J. Ganey
(74) *Attorney, Agent, or Firm*—Jones & Smith, LLP; E. Randall Smith

(57) ABSTRACT

An embodiment of an internal self-rotating fluid nozzle includes a rotor rotatably moveable within a nozzle body cavity. The rotor may include a jewel holder that carries at least one jewel member and spins against a rotor seat disposed near the front of the cavity. The rotor seat may be floating. At least one fluid drive passageway may be disposed within, and oriented angularly relative to the central axis of, the cavity. A fluid flow director may be included, extend around the inner circumference of the cavity and include a protruding portion that directs fluid into a forward portion of the cavity.

40 Claims, 5 Drawing Sheets

INTERNAL SELF-ROTATING FLUID JETTING NOZZLE

This application claims the benefit of U.S. Provisional Patent Application Ser. No. 60/495,593 filed Aug. 15, 2003 and entitled Hydrojet-40.

BACKGROUND OF THE INVENTION

The invention relates to apparatus and methods relating to the field of internal self-rotating fluid jetting nozzles.

Fluid jetting nozzles are useful in a wide range of applications. For example, hydro-jets are used for cleaning, scale and coating removal, steel and concrete surface preparation, concrete etching and hydro-demolition. These nozzles are often coupled to hand-held control guns or automated devices and used in combination with fluid pumps.

One particularly useful type of fluid jetting nozzle is the internal self-rotating, or spin, nozzle. Generally, an insert, or rotor, rotates and spins within a bore of the nozzle and jets fluid out the nozzle. An example self-rotating nozzle is described in U.S. Pat. No. 5,328,097, issued on Jul. 12, 1994 to Wesch et al. and entitled "Rotor Nozzle For a High-Pressure Cleaning Device", which is hereby incorporated by reference herein in its entirety.

Existing self-rotating nozzles are believed to have one or more undesirable feature or disadvantage. For example, the spinning rotor in various devices smashes and/or grinds against one or more other component, causing damage and pre-mature wear. In some devices, performance may be degraded by the absence of a continuous seal formed between the rotor and a forward component. Further, the absence of a continuous seal in some devices requires the nozzle be pointed downwardly at actuation to create the desired seal. For another example, some self-rotating nozzles require the use of air rotary guns. For yet another example, changing the nozzle output often requires a difficult and expensive modification to the nozzle. For even a further example, various existing devices are believed to have a poor safety rating and performance at non-optimal levels.

It should be noted that the above-described disadvantages are only examples, which may not exist in every instance. Merely by mentioning such disadvantages, it is not intended that each claim of this patent be limited to address or exclude each such disadvantage. Accordingly, none of the appended claims should be limited in any way by the above discussion or construed to address or exclude the cited disadvantages, except and only to the extent as may be expressly stated in a particular claim.

Accordingly, there exists a need for self-rotating fluid nozzles and methods having one or more of the following attributes, capabilities or features: has no external moving parts; has as few as a single moving part; is horsepower efficient; directs 100% of the flow rate through the nozzle; provides improved jetting and cutting power over standard air rotary guns and external, mulit-orifice, self-spinning nozzles; can be designed to provide ultra high pressure water jet cleaning and surface preparation of steel and concrete surfaces; provides the power of a straight jet with the coverage of a fan nozzle, such as a 20 degree fan nozzle; does not require use or repair of an air compressor or motor, UHP swivel seal, air rotary gun or tumble box; has no air lines; has a single self-rotating, internal spinning orifice; eliminates the need to replace an expensive inlet insert to change flow and pressure; has a replaceable drive ring to accommodate different fluid jetting capacities; can be supplied with an inexpensive nozzle repair/replacement kit; has removable, interchangeable parts; is lightweight, reliable, rugged, durable, or any combination thereof; is easily and quickly repairable; had a true safety factor of 3:1; has rotor spin technology that provides for extended life of the nozzle; includes metallurgy that provides a good safety factor and longevity; has no spillage wear between the rotor and rotor seat; has a positive lock rotor; can be operated at working pressures of greater than 40,000 psi; can be actuated in any position; or any combination thereof.

BRIEF SUMMARY OF THE INVENTION

Some embodiments of the present invention involve an internal self-rotating, fluid jetting nozzle assembly and include a nozzle body having a main cavity and a front end. An elongated rotor is rotatably moveable within the main cavity and has at least one passageway in fluid communication with the main cavity. A jewel holder is disposed at the front end of the elongated rotor. The jewel holder has a front tip and is capable of carrying at least one jewel member. The jewel member has at least one orifice in fluid communication with the passageway of the elongated rotor. A rotor seat is disposed proximate to the front end of the nozzle body. The rotor seat includes a contact portion and at least one passage in fluid communication with the orifice of the jewel member. The front tip of the jewel holder is capable of spinning against the contact portion of the rotor seat. Fluid may be jetted from the orifice of the jewel member through the passage of the rotor seat.

In various embodiments, an internal self-rotating, fluid nozzle assembly includes a nozzle body having a main cavity and a front end, an elongated rotor rotatably moveable within the main cavity and a floating rotor seat disposed proximate to the front end of the nozzle body. The front end of the elongated rotor is in at least substantially continuous engagement with the floating rotor seat.

The present invention may be embodied in an internal self-rotating fluid nozzle that includes a nozzle body having a main cavity, the main cavity having a central axis extending longitudinally therethrough. At least one fluid inlet is capable of allowing the input of pressurized fluid into the main cavity. A rotor is rotatably moveable within the main cavity. At least one fluid drive passageway is disposed within the main cavity and in fluid communication with the at least one fluid inlet and the main cavity. The at least one fluid drive passageway is oriented angularly relative to the central axis of the main cavity and is capable of dispersing fluid into the main cavity in at least one among a generally swirling and a generally turbulent path to cause the elongated rotor to rotate within the main cavity.

There are embodiments of the present invention involving an internal self-rotating, fluid jetting nozzle assembly that include a nozzle body having a main cavity and a front end. The main cavity includes a forward portion and has a central axis. At least one fluid inlet is capable of allowing the input of pressurized fluid into the main cavity. An elongated rotor is rotatably moveable within the forward portion of the main cavity. A fluid flow director extends around the inner circumference of at least part of the main cavity. The fluid flow director has a portion protruding into the main cavity that is capable of directing fluid into the forward portion of the main cavity to cause the elongated rotor to rotate within the forward portion of the main cavity proximate to the wall of the forward portion.

Various embodiments of the present invention involve an internal self-rotating, fluid jetting nozzle assembly and include a nozzle body having a main cavity and a front end.

An elongated rotor is rotatably moveable within the main cavity. The elongated rotor includes an idler ring extending outwardly therefrom. An engagement surface extends around the inner circumference of at least part of the main cavity. The idler ring includes an outer surface capable of rollingly engaging the engagement surface. A rotor seat is disposed proximate to the front end of the nozzle body. The rotor seat includes a contact portion. The front end of the elongated rotor is capable of spinning against the contact portion. The ratio of the outer diameter of the outer surface of the idler ring to the inner diameter of the main cavity at the engagement surface is equal to the ratio of the outer diameter of the front end of the elongated rotor to the inner diameter of the contact portion of the rotor seat.

Accordingly, the present invention includes features and advantages which are believed to enable it to advance internal self-rotating fluid jetting nozzle technology. Characteristics and advantages of the present invention described above and additional features and benefits will be readily apparent to those skilled in the art upon consideration of the following detailed description of preferred embodiments and referring to the accompanying drawings.

BRIEF DESCRIPTION OF THE DRAWINGS

For a detailed description of preferred embodiments of the invention, reference will now be made to the accompanying drawings wherein.

DETAILED DESCRIPTION OF PREFERRED EMBODIMENTS OF THE INVENTION

Figure 1:
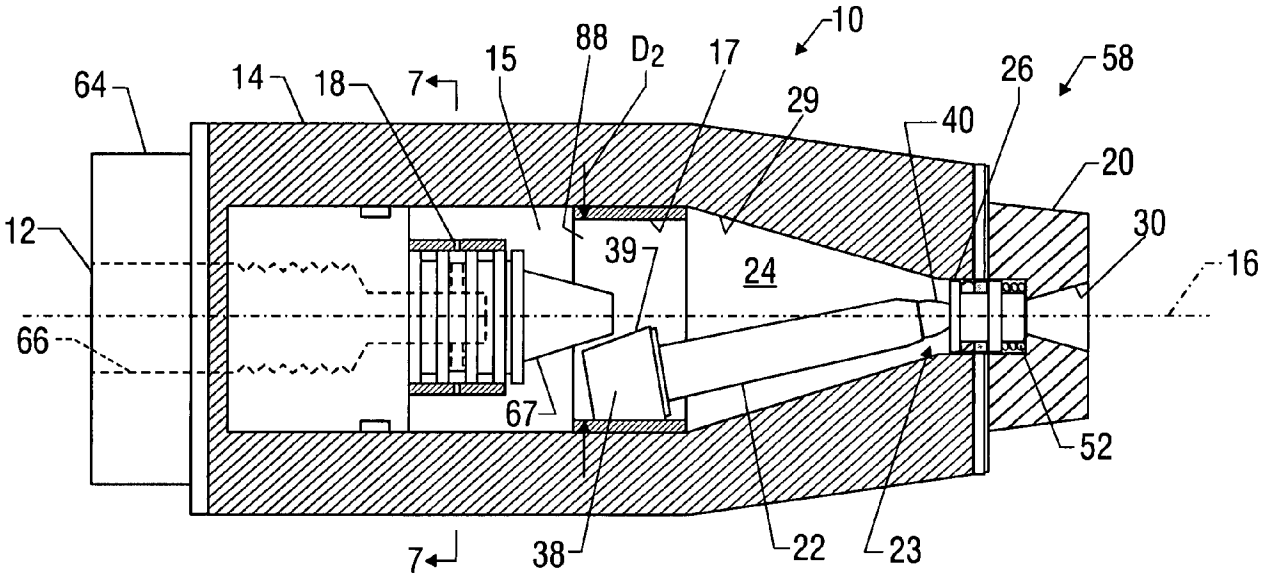
FIG. 1 is a partial cross-sectional view of an embodiment of a nozzle assembly in accordance with the present invention.

Presently preferred embodiments of the invention are shown in the above-identified figures and described in detail below. It should be understood that the appended drawings and description herein are of preferred embodiments and are not intended to limit the invention or the appended claims. On the contrary, the intention is to cover all modifications, equivalents, and alternatives falling within the spirit and scope of the invention as defined by the appended claims. In showing and describing the preferred embodiments, common or similar features are indicated by like or identical reference numerals or, in the absence of a reference numeral, are evident based upon the appended drawings and/or description herein. The figures are not necessarily to scale and certain features and certain views of the figures may be shown exaggerated in scale or in schematic in the interest of clarity and conciseness.

The terms "present invention", "invention" and variations thereof, as used throughout this patent and in the headings herein, means one or more embodiment of the invention. These terms are not intended and should not be construed to mean or refer to the "claimed invention" of all, or any particular, claim or claims of this or any other patent or patent application. Thus, the subject matter referred to in the context of the terms "present invention", "invention" and variations thereof herein is not intended to and should not limit, or be required for, any of the claims merely because of such reference. For example, the BRIEF SUMMARY OF THE INVENTION and DETAILED DESCRIPTION OF PREFERRED EMBODIMENTS sections of this patent discuss non-limiting examples, or embodiments, of the invention. Such discussions and the details thereof are not intended and should not be construed to be required by any claim unless and only to the extent expressly required in the claim itself.

Referring initially to FIG. 1, an embodiment of a nozzle assembly 10 made in accordance with the present invention is shown. The nozzle assembly 10 includes at least one fluid inlet 12, nozzle body 14, fluid drive passageway 18, elongated rotor 22, rotor seat 26 and fluid outlet 30. The nozzle body 14 includes a main cavity 15 into which the desired fluid, such as water, is introduced from a fluid source (not shown) through the at least one fluid inlet 12 and fluid drive passageway 18. Fluid in the main cavity 15 causes the rotor 22 to generally rotate in the main cavity 15, preferably at least partially against the wall 29 or a surface provided thereon. As the rotor 22 moves around in the main cavity 15, fluid passes into the rotor 22 and the front end 23 of the rotor 22 generally spins in the rotor seat 26. Fluid is jetted from the rotor 22, through the rotor seat 26 and out the at least one outlet 30.

Figure 3:
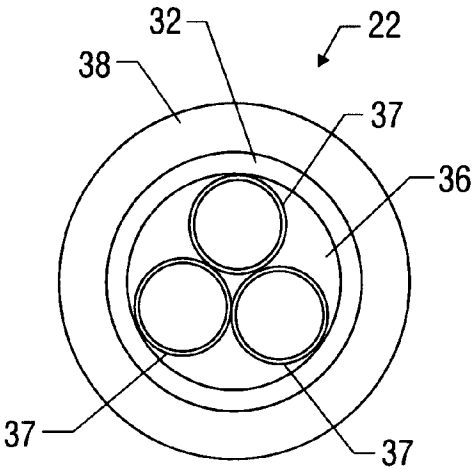
FIG. 3 is an end view of the rotor of FIG. 2 shown including numerous exemplary straightening veins.
Figure 2:
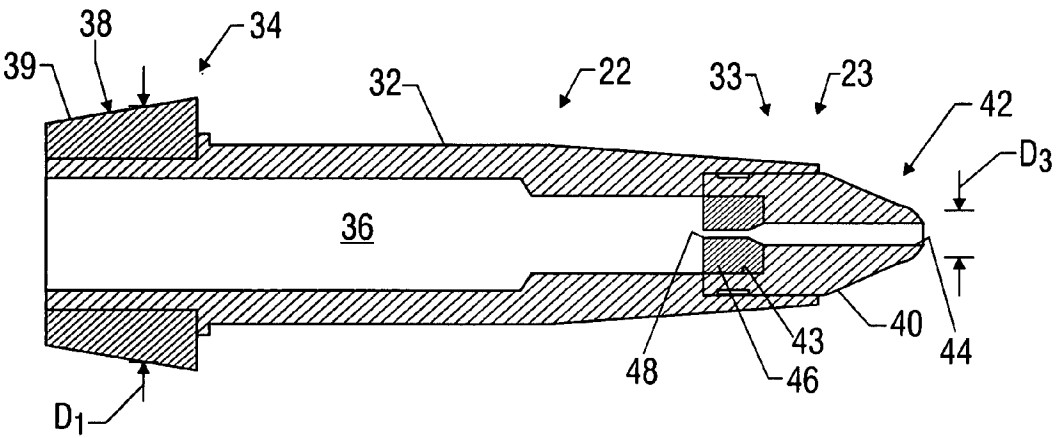
FIG. 2 is a cross-sectional view of the exemplary rotor shown in FIG. 1.

The rotor 22 may take any suitable structure, form and configuration so long as it is generally rotatably moveable in a forward portion 24 of the main cavity 15, engageable with the rotor seat 26 and capable of directing fluid therethrough. In the embodiment of FIG. 2, for example, the rotor 22 includes an elongated rotor tube 32 having a longitudinally extending bore 36 into which fluid enters from the main cavity 15 during operation. The illustrated rotor tube 32 also includes an idler ring 38 proximate to its rear end 34 and a jewel holder 40 at its front end 33. If desired, one or more straightening vein 37 (e.g. FIG. 3) may be disposed within the bore 36, such as to assist in straightening, training or degasifying fluid entering the bore 36. In the example shown, three veins 37 are included, but any desired number of straightening veins 37 may be included. In some embodiments, straightening veins 37 may not be included.

Still referring to FIG. 2, the illustrated idler ring 38 extends angularly outwardly from the rotor tube 32 and includes an outer surface 39 capable of engaging, or rolling along, an engagement surface 17 (e.g. FIG. 1) located in the main cavity 15 of the nozzle body 14. The exemplary idler ring 38 is permanently rigidly affixed to the rotor tube 32, such as by press fitting and gluing. However, the idler ring 38 may be integral to the rotor tube 32, removably connected or incorporated in any other desired manner.

Referring back to FIG. 1, the jewel holder 40 may take any suitable structure, form and configuration so long as it is generally capable of spinningly engaging the rotor seat 26 and directing fluid from the rotor 22 toward the outlet 30. As shown in FIG. 2, the jewel holder 40 of this embodiment has a generally bullet-tip shape with a front tip 42 that is at least partially spherically shaped to generally engage an engagement surface 28 of the rotor seat 26 (e.g. FIG. 5). The jewel holder 40 is rigidly affixed to the rotor tube 32, such as with glue. However, the jewel holder 40 may have any other suitable configuration and structure, and may be connected with the rotor tube 32, or otherwise incorporated in the rotor 22, in any desired manner.

Referring again to FIG. 2, the jewel holder 40 carries at least one jewel member 46. In the embodiment shown, the jewel member 46 is glued in a counterbore 43 in the jewel holder 40, but may be incorporated in the jewel holder 40 or the rotor 22 in any desired manner. The jewel member 46 has an orifice 48 capable of jetting fluid from the rotor 22 to the outlet 30 of the nozzle assembly 10. In the embodiment shown, the orifice 48 extends between the bore 36 of the rotor tube 32 and a passage 44 in the jewel holder 40. The jewel member 46 may take any suitable form and construction so that it is capable of jetting fluid from the rotor 22. Preferably, the jewel member 46 is constructed of a material having sufficient strength and wear characteristics to avoid substantial erosion or pre-mature failure during normal operations.

Figure 5:
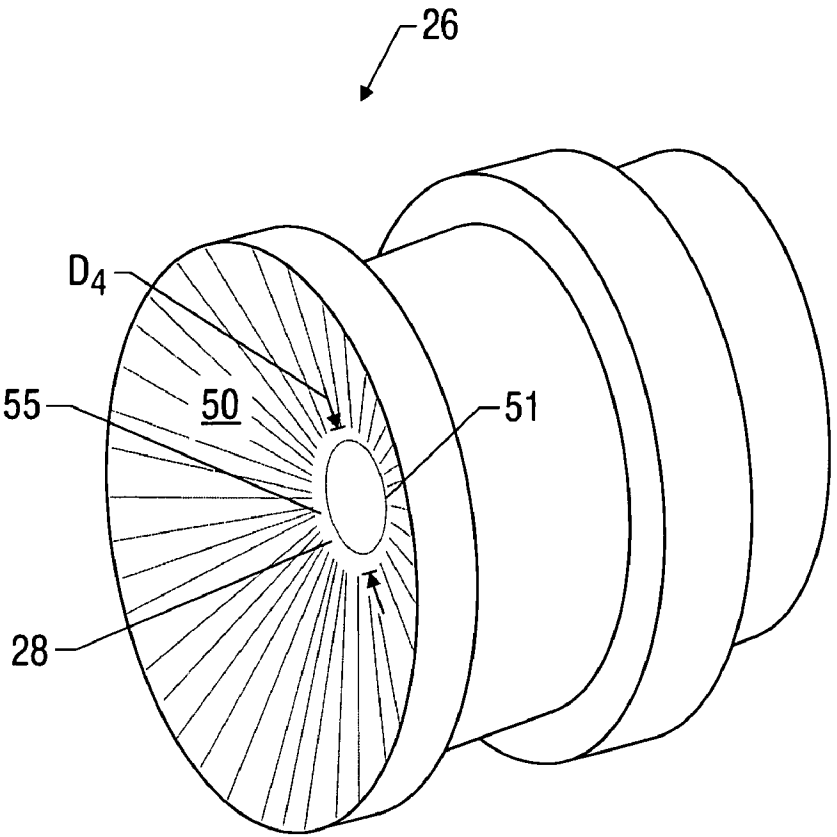
FIG. 5 is an exploded perspective view of the rotor seat of FIG. 4.
Figure 4:
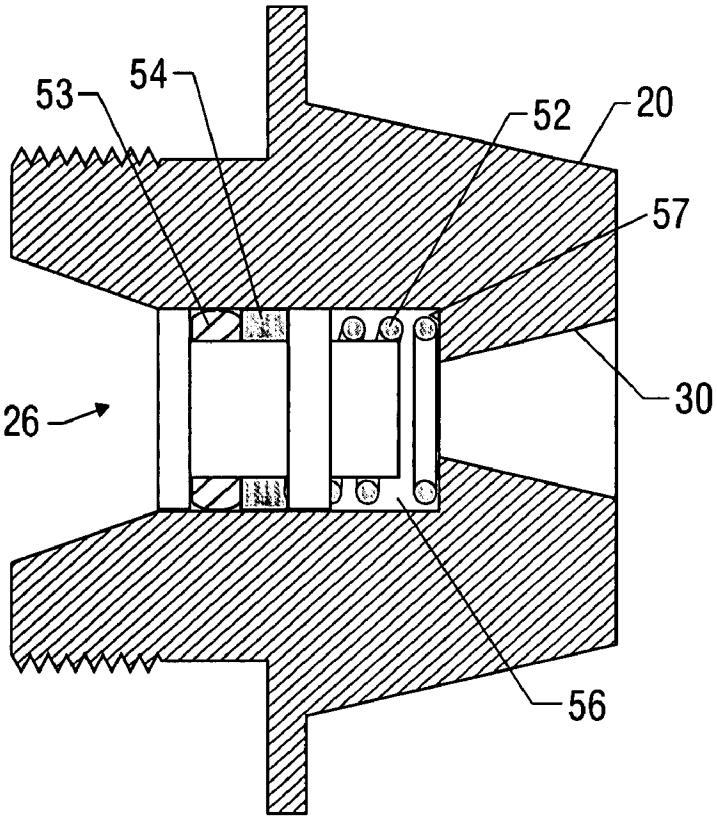
FIG. 4 is a partial cross-sectional view of an embodiment of a rotor seat disposed within an exemplary nozzle cap in accordance with the present invention.

Now referring to the embodiment of FIGS. 4 and 5, the exemplary rotor seat 26 includes a face portion 50 that is at least partially conically shaped. The face portion 50 includes a contact area 55 that bears the engagement surface 28 engaged by the front tip 42 of the jewel holder 40 (e.g. FIG. 2). The illustrated rotor seat 26 also includes a passage 51 in fluid communication between the orifice 48 of the jewel member 46 (e.g. FIG. 2) and the outlet 30.

Figure 9:
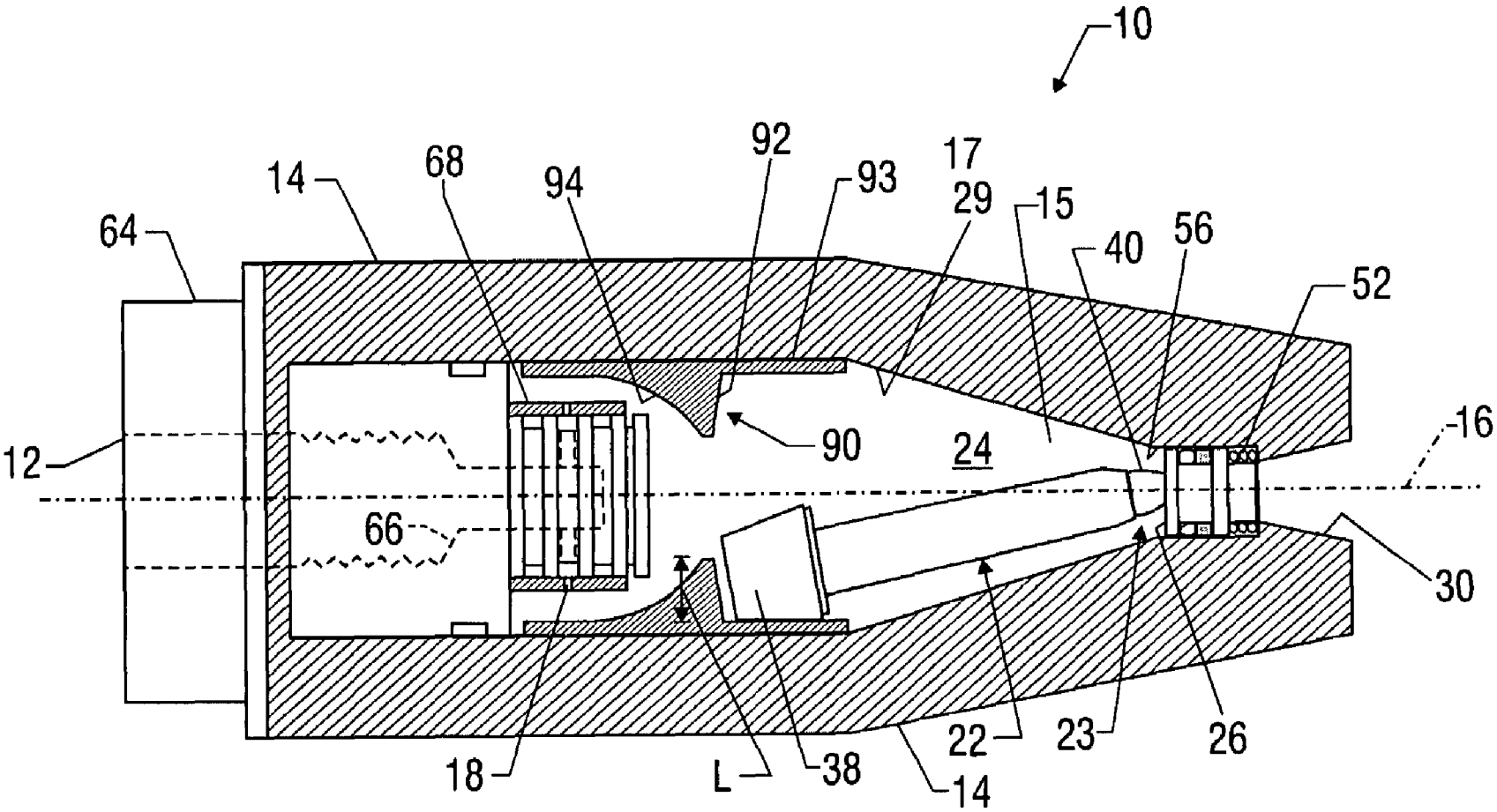
FIG. 9 is a partial cross-sectional view of another embodiment of a nozzle assembly in accordance with the present invention.

The rotor seat 26 may be incorporated in the nozzle assembly 10 in any desired manner. For example, in the embodiment of FIGS. 1 and 4, the rotor seat 26 floats within a space 56 formed in a nozzle cap 20 attached to the front end 58 of the nozzle body 14. One or more sealing members, such as an O-ring seal 53 and back-up ring 54, may be included to form an appropriate seal around the rotor seat 26. However, this arrangement is not required. In the embodiment of FIG. 9, for example, the rotor seat 26 is disposed within a space in the nozzle body 14. For other examples, the rotor seat 26 may be integral to the nozzle body 14 or otherwise incorporated in the nozzle assembly 10.

The floating of the rotor seat 26 may be included for any desired reason. For example, the rotor seat 26 may float to provide continuous engagement of the rotor 22 with the rotor seat 26, eliminating any smashing of the rotor 22 into the rotor seat 26 during operation. For another example, this feature may allow actuation of the nozzle assembly 10 in practically any position. For yet another example, this feature may be included to provide a generally continuous fluid seal between the rotor 22 and the rotor seat 26, avoiding fluid leakage therebetween.

Referring still to FIGS. 1 and 4, the floating of the rotor seat 26 of this example is provided by a spring 52 extending between the rotor seat 26 and an annular ledge 57 of the space 56. During operation of this embodiment, fluid pressure in the main cavity 15 pushes the rotor 22 forward, which pushes the rotor seat 26 forward, compressing the spring 52.

In the embodiment of FIG. 9, during non-actuation of the nozzle assembly 10, spring force of the spring 52 biases the rotor 22 against a fluid flow director 92 disposed in the main cavity 15. In operation, fluid pressure in the main cavity 15 pushes the rotor 22 off the fluid flow director 92 (allowing the rotor 22 to rotate in the main cavity 15) and compressing the spring 52. However, more than one spring 52 or any other suitable component(s) or feature may be utilized to allow floating of the rotor seat 26, if this feature is included.

Figure 8:
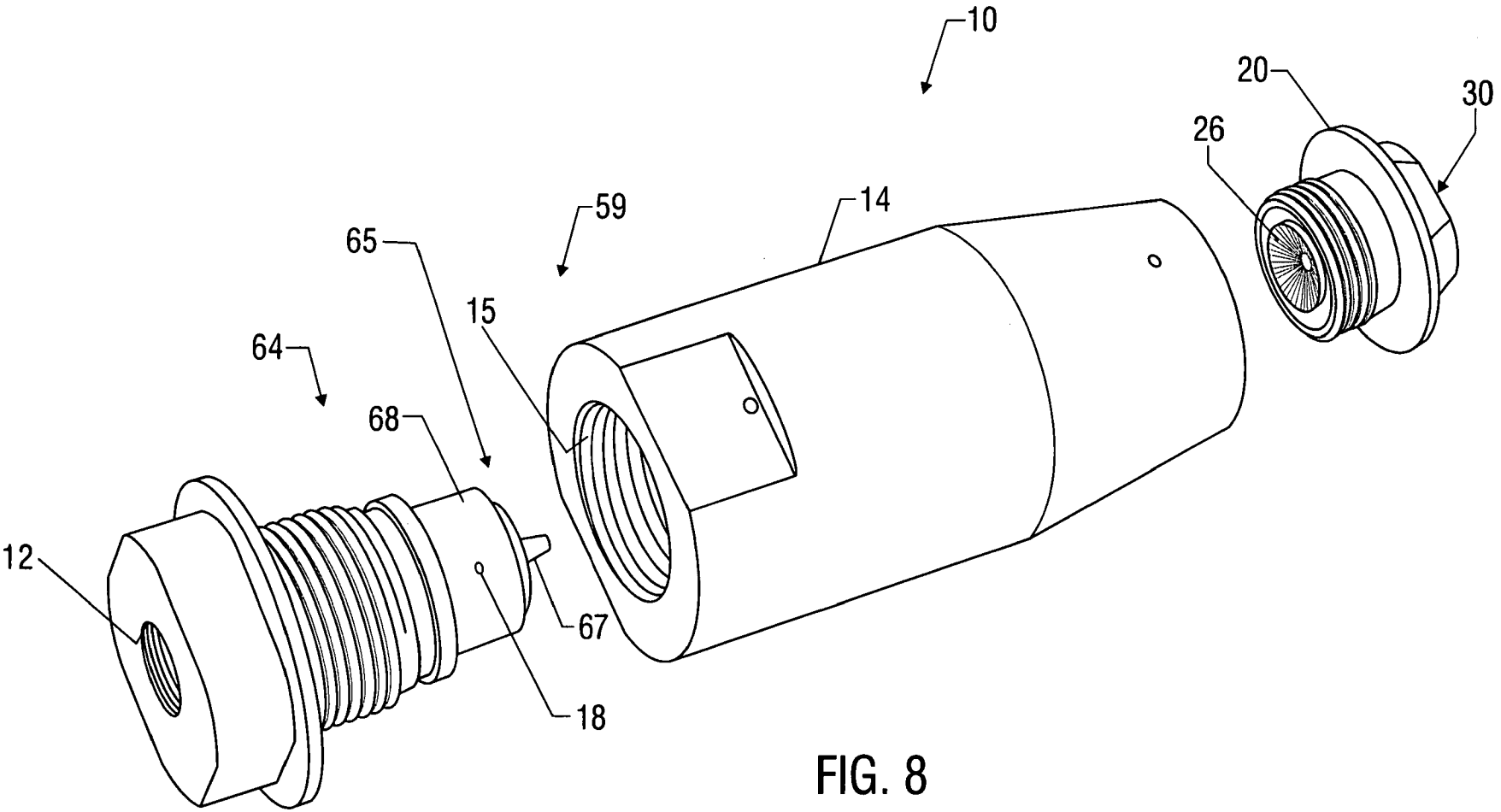
FIG. 8 is an assembly view of the exemplary nozzle assembly of FIG. 1.

Referring specifically to FIG. 1, the exemplary outlet 30 provides clearance for fluid jetted from the rotor 22. The illustrated outlet 30 has an outwardly angled wall and is formed in the nozzle cap 20 (see also, FIG. 8). However, the outlet 30 may take any other suitable configuration and may be located in any suitable component of the nozzle assembly 10. For example, in the embodiment of FIG. 9, the outlet 30 is formed directly in the nozzle body 14. If desired, a deflection shield, such as a ring-like member (not shown), may be connected to the nozzle assembly 10 around the outlet 30 to prevent damage to the nozzle assembly 10, such as from back-spray, during operations.

With respect to another independent aspect of the present invention, any desired components and techniques may be used to cause the rotor 22 to rotate or spin as desired in the main cavity 15 of the nozzle body 14. Referring to FIG. 1, the illustrated embodiment includes an inlet insert 64 (see also, FIG. 8) removably connectable between the rear end 59 of the nozzle body 14 and a fluid source (not shown) or other device, such as fluid jetting handgun or automated device (not shown).

Figure 6:
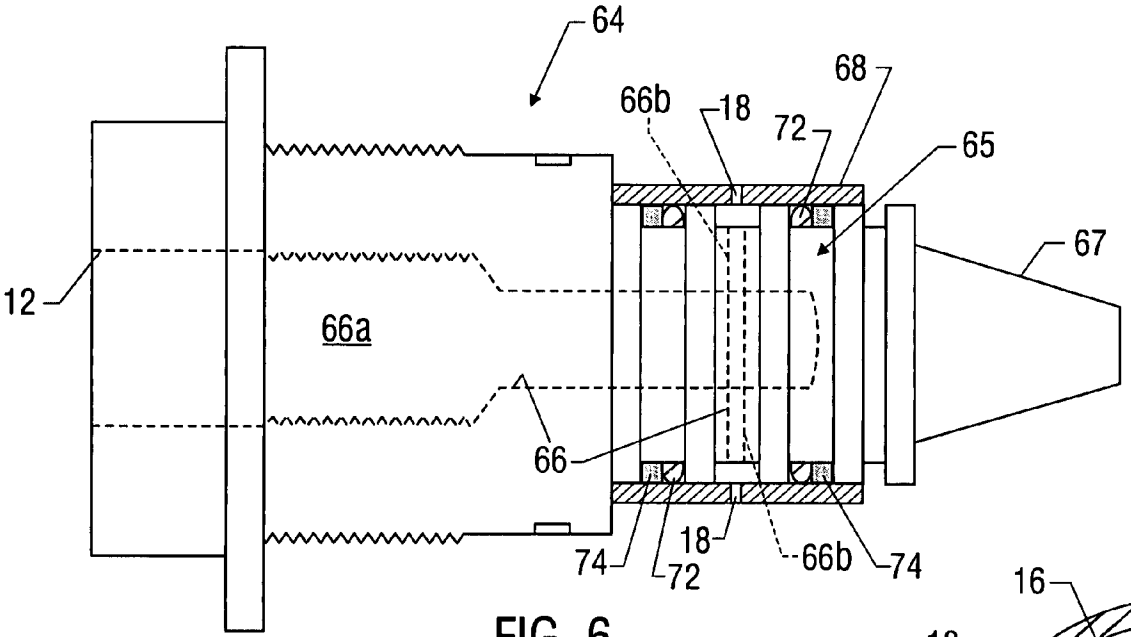
FIG. 6 is an isolated, partial cross-sectional view of the exemplary inlet insert shown in FIG. 1.

As shown in FIG. 6, the exemplary inlet insert 64 includes an inlet cap 65 and nipple member 67. The nipple member 67 protrudes into the main cavity 15 (FIG. 1) to assist in maintaining the desired positioning of the rotor 22, and generally prevent the rotor 22 from crossing the central axis 16 of the main cavity 15 during operations. The inlet cap 65 carries a drive ring 68, which includes the fluid drive passageway(s) 18. The inlet insert 64 of this embodiment also includes one or more fluid inlet 12 and fluid passage 66. The fluid passages 66 allow the flow of fluid from the inlet 12, through the inlet insert 64 and to the fluid drive passageways 18.

Figure 7:
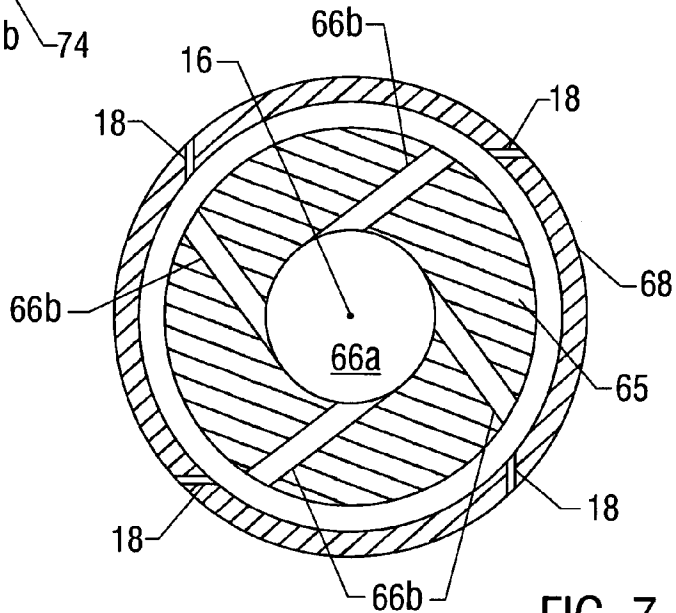
FIG. 7 is a cross-sectional view of the exemplary inlet cap and drive ring of FIG. 1 taken along line 7-7 of FIG. 1.

In the embodiment of FIGS. 6 and 7, fluid flows from a first fluid passage 66*a*, to a series of fluid passages 66*b* in the inlet cap 65 to fluid drive passageways 18. For example, four fluid passages 66*a* are each oriented at a generally ninety degree angle relative to the passage 66*a* and are in fluid communication with the fluid drive passageways 18. However, any desired quantity, size and orientation of the fluid passages 66*a*, 66*b* and fluid drive passageways 18 may be included. The passages 66 and/or fluid drive passageways 18 may, if desired, be designed to achieve a desired spin rate of the rotor 22 or fluid jetting capacity or velocity of the nozzle assembly 10.

One or more sealing members, such as O-ring seals 72 and back-up rings 74, may be included to form an appropriate seal between the inlet insert 64 and drive ring 68. However, any desired type and quantity of sealing members may or may not be used. In this embodiment, the drive ring 68 is slid over the O-ring seals 72 and is removable. The drive ring 68 may be switched out to accommodate different desired fluid jetting capacities. However, the drive ring 68 may, in other instances, be permanently fixed to or integral with the inlet insert 64. Further, the fluid drive passageways 18 may be formed in any other suitable component.

Now referring FIG. 7, each fluid drive passageway 18 of the drive ring 68 of this embodiment is oriented angularly relative to the central axis 16 of the main cavity 15 (FIG. 1), or tangentially relative to the adjacent fluid passage 66*b* in the inlet cap 65. For example, each fluid drive passageway 18 may be about 0.450 inches on a tangent to the centerline of the drive ring 68. Fluid thus exists the drive passageways 18 into the main cavity 15 (e.g. FIG. 1) of the nozzle body 14 angularly relative to the central axis 16 of the main cavity 15. However, the drive passageways 18 may be formed in a different component and have any other suitable configuration and orientation.

In the example of FIG. 1, fluid dispersed from the fluid drive passageways 18 during operation moves in a generally swirling or turbulent path through the conically shaped forward portion 24 of the main cavity 15, driving the rotor 22 toward and preferably around the interior wall 29. As the rotor 22 rotates around in the main cavity 15, the idler ring 38 preferably engages or rolls along the engagement surface 17. In the embodiment shown, the engagement surface 17 is formed on a wear ring 88 extending around the main cavity 15.

In the embodiment of FIG. 9, the engagement surface 17 is formed on a forward portion 93 of the flow ring 90 disposed with the main cavity 15. Further, the fluid flow director 92 of the flow ring 90 includes a curved fluid contact surface 94 capable of assisting in directing the flow of fluid exiting the fluid drive passageways 18. In this example, the flow of fluid is preferably directed into the forward portion 24 of main cavity 15 in a generally hourglass or swirling flow pattern to rotate and spin the rotor 22 around in the main cavity 15. If desired, the angle and curvature of the surface 94 may be selected as desired to achieve the desired fluid flow direction and characteristics. The length L of the fluid flow director 92 may be selected to prevent the fluid moving over the contact surface 94 from directly contacting the adjacent rotor 22, such as by hitting the adjacent edge of the idler ring 38. The illustrated flow ring 90 (FIG. 9) and wear ring 88 (FIG. 1) are removably fixed inside the main cavity 15, such as by press fitting. However, the flow ring or wear ring may instead be integral with or permanently fixed to the nozzle body 14. Further, any other mechanism for engaging the idler ring 38 and/or directing the flow of fluid from the fluid drive passageway(s) 18 may be included.

In yet another independent aspect of the present invention, referring to the embodiment of FIG. 1, it may be desirable to prevent skidding or grinding of the idler ring 38 on the engagement surface 17 or the front end 23 of the rotor 22 on the rotor seat 26. For example, the nozzle assembly 10 may be designed so that the rolling of the idler ring 38 on the engagement surface 17 is synchronized with the spinning of the front tip 42 of the jewel holder 40 (FIG. 2) on the contact area 55 of the face portion 50 (FIG. 5) of the rotor seat 26. This may be accomplished, for example, by designing the nozzle assembly 10 so that the ratio of the outer diameter $D_1$ of the idler ring 38 (FIG. 2) to the inner diameter $D_2$ of the main cavity 15 at the engagement surface 17 (FIG. 1) is equal or nearly equal to the ratio of the outer diameter $D_3$ of the front tip 42 of the jewel holder 40 (FIG. 2) to the inner diameter $D_4$ of the contact area 55 of the face portion 50 of the rotor seat 26 (FIG. 5).

In yet another independent aspect of the present invention, the nozzle assembly 10 may be designed to provide a particular jet or spray angle or path (not shown) of the fluid exiting through the outlet 30. For example, the inner diameter of the main cavity 15 and the angle of the wall 29 in the forward portion 24 may be selected to provide a particular spray path. The greater the angle of the conical wall 29 of the forward portion 24, the greater the output spray angle.

The nozzle body 14, inlet insert 64 and nozzle cap 20 (when included) may be constructed of any desired material, such as to provide desired safety and longevity. For example, these components may be constructed of a stainless steel material that is very hard, not brittle, ductile and has good elongation and shock-loading properties to provide a safety factor of 3:1 at up to 55,000 psi.

The idler ring 38, engagement surface 17, jewel holder 40 and rotor seat 26 may be constructed of any desired material. For example, these components may each be constructed of the same material that is durable, hard and not brittle, and with good wear and shock loading characteristics to avoid substantial erosion during operation.

In accordance with another independent aspect of the present invention, the nozzle assembly 10 may be designed with one or more of the above features to operate at any desired working pressure, including low pressure, high pressures and ultra-high pressures. For example, the nozzle assembly 10 may be designed to operate at working pressures of greater than 40,000 psi.

Preferred embodiments of the present invention thus offer advantages over the prior art and are well adapted to carry out one or more of the objects of the invention. It should be understood that all of the above components and any other components that may be included may have any suitable desired size, material construction, configuration, form and quantity, as is or becomes known. The present invention is in no way limited to the components, configurations, dimensions, specific examples or other details described above or shown in the attached figures. Further, the above-described features are not limited to the details as described and shown. Yet further, each such feature can be used independently of any other feature. Moreover, the present invention does not require each of the above features and includes further capabilities, functions, methods, uses and applications, as will be apparent to a person skilled in the art based upon the description above and the appended drawings and claims.

While preferred embodiments of this invention have been shown and described, many variations, modifications and/or changes, such as in the components, details of construction and operation, arrangement of parts and/or methods of manufacture or assembly, are possible, contemplated by the patentee, within the scope of the appended claims, and may be made and used by one of ordinary skill in the art without departing from the spirit or teachings of the invention and scope of appended claims. Thus, all matter herein set forth or shown in the accompanying drawings should thus be interpreted as illustrative and not limiting. Accordingly, the scope of the invention and the appended claims is not limited to the embodiments described and shown herein.

I claim:

1. An internal self-rotating, fluid jetting nozzle assembly comprising:

a nozzle body having a main cavity and a front end;

an elongated rotor rotatably moveable within said main cavity and having at least one passageway in fluid communication with said main cavity;

a jewel holder disposed at a front end of said elongated rotor, said jewel holder having a front tip and being capable of carrying at least one jewel member, said at least one jewel member having at least one orifice in fluid communication with said at least one passageway of said elongated rotor; and a rotor seat disposed proximate to said front end of said nozzle body, said rotor seat including a contact portion and at least one passage in fluid communication with said at least one orifice of said jewel member, whereby said front tip of said jewel holder is capable of spinning against said contact portion of said rotor seat and wherein fluid may be jetted from said at least one orifice of said jewel member through said at least one passage of said rotor seat.

2. The internal self-rotating fluid jetting nozzle assembly of claim 1 wherein said jewel holder and said rotor seat are in substantially continuous engagement.

3. The internal self-rotating fluid jetting nozzle assembly of claim 2 wherein said rotor seat is spring-biased.

4. The internal self-rotating fluid jetting nozzle assembly of claim 3 wherein said front tip of said jewel holder and said contact portion of said rotor seat are in substantially continuous sealing engagement.

5. The internal self-rotating fluid jetting nozzle assembly of claim 1 wherein said front tip of said jewel holder is at least partially spherically shaped, wherein said rotor seat includes an at least partially conically shaped portion and wherein said contact portion of said rotor seat is formed on said at least partially conically shaped portion, whereby said front tip of said jewel holder is spinningly engageable with said at least partially conically shaped portion of said rotor seat.

6. The internal self-rotating fluid jetting nozzle assembly of claim 1 wherein said jewel holder and said rotor seat are constructed of the same material.

7. The internal self-rotating fluid jetting nozzle assembly of claim 1 further including an idler ring extending outwardly from said elongated rotor, and an engagement surface extending around at least part of said main cavity, wherein at least part of said idler ring is capable of rollingly engaging said engagement surface.

8. The internal self-rotating fluid jetting nozzle assembly of claim 7 wherein said engagement surface, said jewel holder, said contact portion of said rotor seat and said part of said idler ring that is rollingly engageable with said engagement surface are constructed of substantially the same material.

9. The internal self-rotating fluid jetting nozzle assembly of claim 7 wherein the ratio of the outer diameter of said rollingly engageable part of said idler ring to the inner diameter of said main cavity at said engagement surface is equal to the ratio of the outer diameter of said front tip of said jewel holder to the inner diameter of said contact portion of said rotor seat.

10. The internal self-rotating fluid jetting nozzle assembly of claim 7 wherein said engagement surface is formed on a wear ring disposed within said main cavity.

11. An internal self-rotating fluid nozzle assembly comprising:

a nozzle body having a main cavity and a front end;

an elongated rotor rotatably moveable within said main cavity, wherein said elongated rotor includes at least one passageway in fluid communication with said main cavity;

at least two straightening veins disposed at least partially within said at least one passageway of said elongated rotor, said at least two straightening veins being capable of at least one among straightening, training and degasifying fluid entering said at least one passageway; and a floating rotor seat disposed proximate to said front end of said nozzle body, wherein the front end of said elongated rotor is in at least substantially continuous engagement with said floating rotor seat.

12. The internal self-rotating fluid nozzle assembly of claim 11 further including at least one protruding member extending into said main cavity from the wall of said main cavity, whereby when the nozzle assembly is not actuated, said elongated rotor is engaged between said at least one protruding member and said floating rotor seat and after the nozzle assembly is actuated, said elongated rotor and said floating rotor seat are driven in the direction of said front end of said nozzle body, removing said elongated rotor from engagement with said at least one protruding member and allowing said elongated rotor to rotatably move within said main cavity of said nozzle body.

13. The internal self-rotating fluid nozzle assembly of claim 12 wherein said floating rotor seat is spring-biased.

14. The internal self-rotating fluid nozzle assembly of claim 11 further including a fluid inlet, said fluid inlet capable of allowing the input of pressurized fluid into said main cavity, wherein said floating rotor seat includes at least one passage in fluid communication with said at least one passageway of said elongated rotor, said elongated rotor and said floating rotor seat being in at least substantially continuous sealing engagement during operation of the nozzle assembly.

15. internal self-rotating fluid nozzle assembly of claim 11 further including three straightening veins disposed within said at least one passageway of said elongated rotor.

16. The internal self-rotating fluid nozzle assembly of claim 14 further including a jewel holder disposed at the front end of said elongated rotor, said jewel holder capable of carrying at least one jewel member and having a front tip that is engageable with said floating rotor seat.

17. The internal self-rotating fluid nozzle assembly of claim 16 wherein said jewel member includes at least one orifice in fluid communication between said at least one passageway of said elongated rotor and said at least one passage of said floating rotor seat, whereby said front tip of said jewel holder and said floating rotor seat are in substantially continuous sealing engagement.

18. The internal self-rotating fluid nozzle assembly of claim 16 wherein said floating rotor seat is disposed within a space in said nozzle body.

19. An internal self-rotating fluid nozzle comprising:

a nozzle body having a main cavity, said main cavity having a central axis extending longitudinally therethrough;

an inlet insert disposed at least partially within said main cavity, said inlet insert having at least one fluid inlet and at least one passage capable of allowing the input of pressurized fluid into said main cavity;

a rotor rotatably moveable within said main cavity; and at least one fluid drive passageway formed in a removable drive ring slideably disposed upon said inlet insert within said main cavity, said at least one fluid drive passageway being in fluid communication with said at least one passage of said inset insert and said main cavity and capable of directing fluid into said main cavity, wherein a gap is formed between said at least one fluid drive passageway of said drive ring and said at least one passage of said inlet insert, whereby said gap allows said removable drive ring to be emplaced by being slid onto said inlet insert over said at least one passage without the necessity of orienting said at least one fluid drive passageway with said at least one passage.

20. The internal self-rotating fluid nozzle of claim 19 wherein said at least one fluid drive passageway is oriented at a tangential angle relative to said central axis of said main cavity.

21. The internal self-rotating fluid nozzle of claim 20 further including at least three said fluid drive passageways.

22. The internal self-rotating fluid nozzle of claim 21 wherein said inlet insert is removably engageable with said nozzle body.

23. The internal self-rotating fluid nozzle of claim 19 wherein said nozzle body has a safety factor of approximately 3:1 during operation of the nozzle at a working pressures of up to 55,000 psi.

24. The internal self-rotating fluid nozzle of claim 19 further including a jewel holder disposed at the front end of said rotor, at least one jewel member disposed within said jewel holder, and a rotor seat disposed proximate to said front end of said nozzle body, wherein said jewel holder is capable of spinningly engaging said rotor seat.

25. The internal self-rotating fluid nozzle of claim 24 wherein said jewel holder and said rotor seat are in substantially continuous engagement.

26. The internal self-rotating fluid nozzle of claim 25 wherein said rotor seat is floating.

27. The internal self-rotating fluid nozzle of claim 26 further including an idler ring extending outwardly from said rotor, and an engagement surface extending around at least part of said main cavity, wherein at least part of said idler ring is capable of rollingly engaging said engagement surface.

28. The internal self-rotating fluid nozzle of claim 27 wherein said engagement surface, said jewel holder, said rotor seat and said idler ring are constructed of substantially the same material.

29. An internal self-rotating, fluid jetting nozzle assembly comprising:

a nozzle body having a main cavity and a front end, said main cavity including a forward portion and having a central axis;

at least one replaceable wear ring disposed within said main cavity, said wear ring having at least one engagement surface extending around at least part of said main cavity;

at least one fluid inlet capable of allowing the input of pressurized fluid into said main cavity; and an elongated rotor rotatably moveable within said forward portion of said main cavity, said elongated rotor including an idler ring rigidly secured to said elongated rotor and extending outwardly therefrom, said idler ring being capable of rollingly engaging said engagement surface, wherein said idler ring is constructed of at least one hard, non-elastomeric material capable of avoiding substantial erosion due to rollingly engaging said engagement surface during normal operations.

30. The internal self-rotating, fluid jetting nozzle assembly of claim 29, further including a removable fluid flow director extending around the inner circumference of at least part of said main cavity, said fluid flow director having a portion protruding into said main cavity and capable of directing fluid into said forward portion of said main cavity to cause said elongated rotor to rotate within said forward portion of said main cavity proximate to the wall of said forward portion, wherein said protruding portion includes a curved surface.

31. The internal self-rotating, fluid jetting nozzle assembly of claim 30 wherein said protruding portion is capable of directing fluid into said forward portion of said main cavity in at least one among a generally swirling and a generally hourglass path.

32. The internal self-rotating, fluid jetting nozzle assembly of claim 29 wherein said engagement surface and said part of said idler ring that is rollingly engageable with said engagement surface are constructed of the same non-elastomeric material.

33. The internal self-rotating, fluid jetting nozzle assembly of claim 29 further including at least one fluid drive passageway disposed within said main cavity and in fluid communication with said at least one fluid inlet and said main cavity, said at least one fluid drive passageway being oriented angularly relative to said central axis of said main cavity.

34. The internal self-rotating, fluid jetting nozzle assembly of claim 33 wherein said at least one fluid drive passageway is formed in a removable drive ring.

35. The internal self-rotating, fluid jetting nozzle assembly of claim 34 further including at least four said fluid drive passageways.

36. An internal self-rotating, fluid jetting nozzle assembly comprising:

a nozzle body having a main cavity and a front end;

an elongated rotor rotatably moveable within said main cavity, said elongated rotor including an idler ring extending outwardly therefrom;

an engagement surface extending around the inner circumference of at least part of said main cavity, wherein said idler ring includes an outer surface capable of rollingly engaging said engagement surface; and a rotor seat disposed proximate to said front end of said nozzle body, said rotor seat including a contact portion, wherein said front end of said elongated rotor is capable of spinning against said contact portion, wherein the ratio of the outer diameter of said outer surface of said idler ring to the inner diameter of said main cavity at said engagement surface is equal to the ratio of the outer diameter of said front end of said elongated rotor to the inner diameter of said contact portion of said rotor seat.

37. The internal self-rotating, fluid jetting nozzle assembly of claim 36 further including a jewel holder disposed at the front end of said elongated rotor, said jewel holder capable of carrying at least one jewel member.

38. The internal self-rotating, fluid jetting nozzle assembly of claim 37 wherein said rotor seat is floating.

39. The internal self-rotating, fluid jetting nozzle assembly of claim 38 wherein said rotor seat is spring-biased.

40. The internal self-rotating, fluid jetting nozzle assembly of claim 37 wherein said jewel holder and said rotor seat are constructed of the same material.

* * * * *